US011450985B2

(12) United States Patent
Sundarakrishnamachari et al.

(10) Patent No.: US 11,450,985 B2
(45) Date of Patent: Sep. 20, 2022

(54) CONNECTOR WITH INTEGRATED SEAL RETAINER AND SECONDARY TERMINAL LOCK

(71) Applicant: Aptiv Technologies Limited, St. Michael (BB)

(72) Inventors: Rangarajan Sundarakrishnamachari, Chennai (IN); Sivakumar Jogula, Nagar Kurnool (IN)

(73) Assignee: APTIV LIMITED TECHNOLOGIES

( * ) Notice: Subject to any disclaimer, the term of this patent is extended or adjusted under 35 U.S.C. 154(b) by 5 days.

(21) Appl. No.: 16/992,594

(22) Filed: Aug. 13, 2020

(65) Prior Publication Data

US 2022/0052477 A1 Feb. 17, 2022

(51) Int. Cl.
*H01R 13/52* (2006.01)
*H01R 13/506* (2006.01)
*H01R 13/424* (2006.01)

(52) U.S. Cl.
CPC ..... *H01R 13/5202* (2013.01); *H01R 13/424* (2013.01); *H01R 13/506* (2013.01)

(58) Field of Classification Search
CPC ..... H01R 13/506; H01R 13/5202; H01R 13/5219; H01R 13/424; H01R 13/4365
See application file for complete search history.

(56) References Cited

U.S. PATENT DOCUMENTS 7,241,155 B2 7/2007 Tyler et al.
8,187,042 B2 * 5/2012 Kimura ..... H01R 13/52 439/752
2001/0016457 A1 * 8/2001 Taguchi ..... H01R 13/4367 439/752
2002/0142655 A1 * 10/2002 Nimura ..... H01R 13/5208 439/595
2009/0042438 A1 * 2/2009 Iwahori ..... H01R 13/4365 439/521
2016/0149336 A1 * 5/2016 Smith ..... H01R 4/22 439/587
2018/0277983 A1 * 9/2018 Shimizu ..... B60R 16/0222
2018/0342828 A1 * 11/2018 Kobayashi ..... H01R 13/5208

* cited by examiner

*Primary Examiner* — Oscar C Jimenez
(74) *Attorney, Agent, or Firm* — Billion & Armitage

(57) ABSTRACT

A connector assembly includes a connector body defining a terminal cavity configured to receive a terminal therein and extending along a longitudinal mating axis. The connector assembly also includes a compliant seal peripherally surrounding the connector body. The connector assembly further includes a retainer that peripherally surrounds a portion of the connector body and is movable to a first position in which the retainer inhibits movement of the seal along the mating axis and allows insertion of the terminal within the terminal cavity. The retainer is further movable from the first position to a second position in which the retainer inhibits movement of the seal along the mating axis while also inhibiting removal of the terminal from the terminal cavity. A method of assembling a connector is also presented.

14 Claims, 6 Drawing Sheets

CONNECTOR WITH INTEGRATED SEAL RETAINER AND SECONDARY TERMINAL LOCK

TECHNICAL FIELD OF THE INVENTION

The present invention relates generally to electrical connectors and more particularly to sealed electrical connector assemblies haying a seal and an independent secondary terminal lock.

BACKGROUND OF THE INVENTION

A wide variety of connectors have been developed for joining the ends of electrical conductors to other elements in a circuit. In mass produced products, such as automotive products and appliances, it is common practice to have the electrical circuits include preassembled wiring harnesses to which elements of the device are connected in a predetermined sequence during assembly. Terminals commonly used at the ends of the wiring harness wires are typically contained within terminal cavities of a connector body. The terminals may be retained within the terminal cavities by two types of terminal locks: flexible primary retainers which allow a terminal to be inserted within a terminal cavity and rigid secondary retainers which prevent the terminal from being removed once the terminal is properly inserted. The connectors may also include sealing elements to inhibit ingress of environmental contaminants, e.g. dust, dirt, water, or other fluids, into the connector body that may degrade the electrical properties of the terminals.

The subject matter discussed in the background section should not be assumed to be prior art merely because of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

According to one embodiment of the invention, a connector assembly is provided. The connector assembly includes a connector body defining a terminal cavity configured to receive a terminal therein. The connector body extends along a longitudinal mating axis. The connector assembly also includes a compliant seal that peripherally surrounds the connector body. The connector assembly further includes a retainer that peripherally surrounds a portion of the connector body. The retainer is movable along the mating axis to a first position in which the retainer inhibits movement of the seal and allows insertion of the terminal within the terminal cavity. The retainer is further movable from the first position to a second position in which the retainer inhibits movement of the seal along the mating axis and inhibits removal of the terminal from the terminal cavity.

In an example embodiment having one or more features of the connector assembly of the previous paragraph, the retainer may extend around a face of the seal.

In an example embodiment having one or more features of the connector assembly of any one of the previous paragraphs, the retainer may be movable along the mating axis to the first position and wherein the retainer may be movable from the first position to the second position along a transverse axis that is perpendicular to the mating axis.

In an example embodiment having one or more features of the connector assembly of any one of the previous paragraphs, the connector body may further include first flexible locking features that are configured to maintain a location of the retainer along the mating axis when the retainer is in either the first position or the second position.

In an example embodiment having one or more features of the connector assembly of any one of the previous paragraphs, the connector body may further include second flexible locking features configured to maintain a location of the retainer along the transverse axis when the retainer is in the first position and release the retainer to move along the transverse axis to the second position.

In an example embodiment having one or more features of the connector assembly of any one of the previous paragraphs, the connector body may further include longitudinal ribs configured to guide the retainer along the mating axis as the retainer is moved into the first position.

In an example embodiment having one or more features of the connector assembly of any one of the previous paragraphs, the first flexible locking features may define the longitudinal ribs.

In an example embodiment having one or more features of the connector assembly of any one of the previous paragraphs, the connector body may be an inner connector body and the connector assembly may further include an outer connector body within which the inner connector body is disposed.

In an example embodiment having one or more features of the connector assembly of any one of the previous paragraphs, the retainer may be configured to inhibit the seal from deforming along the mating axis as the connector assembly is moved within a corresponding mating connector.

In an example embodiment having one or more features of the connector assembly of any one of the previous paragraphs, the connector body may define a flexible primary terminal lock within the terminal cavity configured to allow insertion of the terminal. The retainer may include a rigid secondary terminal lock configured to inhibit removal of the terminal from the terminal cavity.

According to one embodiment of the invention, a method of assembling a connector having an inner connector body extending along a longitudinal mating axis and defining a terminal cavity configured to receive a terminal therein, a compliant seal, a retainer movable along the mating axis, and an outer connector body is provided. The method includes the steps of placing the compliant seal in a location on the inner connector body such that it peripherally surrounds the inner connector body, sliding the retainer along the mating axis to a first position in which the retainer extends around the seal, thereby inhibiting movement of the seal along the mating axis and in which the retainer allows insertion of the terminal within the terminal cavity, and disposing the inner connector body within the outer connector body while the retainer is in the first position.

In an example embodiment having one or more features of the method of the previous paragraph, the method may further include the steps of inserting the terminal within the terminal cavity and sliding the retainer along a transverse axis that is perpendicular to the mating axis from the first position to a second position configured to retain the seal to the connector body and retain the terminal within the terminal cavity. The retainer may inhibit movement of the seal along the mating axis when the retainer is in the second position.

In an example embodiment having one or more features of the method of any one of the previous paragraphs, the connector body may further include first flexible locking features. The method may further include the step of sliding the retainer along the mating axis until the first locking features engages the retainer to maintain a location of the retainer along the mating axis.

In an example embodiment having one or more features of the method of any one of the previous paragraphs, the connector body may further include second flexible locking features configured to maintain a location of the retainer along the transverse axis when the retainer is in the first position and release the retainer to move along the transverse axis to the second position.

In an example embodiment having one or more features of the method of any one of the previous paragraphs, the connector body may further include longitudinal ribs configured to guide the retainer along the mating axis as the retainer is moved into the first position.

In an example embodiment having one or more features of the method of any one of the previous paragraphs, the first flexible locking features may define the longitudinal ribs.

In an example embodiment having one or more features of the method of any one of the previous paragraphs, the retainer may be configured to inhibit the seal from deforming along the mating axis as the connector is received within a mating connector.

According to one embodiment of the invention, a connector assembly is provided. The connector assembly includes a connector body defining a terminal cavity extending along a longitudinal mating axis configured to receive a terminal therein, a compliant seal surrounding a portion of the connector body, a means for inhibiting movement of the seal along the mating axis, and a means for inhibiting removal of the terminal from the terminal cavity.

In an example embodiment having one or more features of the connector assembly of the previous paragraph, the means for inhibiting movement of the seal along the mating axis is integral with the means for inhibiting removal of the terminal from the terminal cavity.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Reference will now be made in detail to embodiments, examples of which are illustrated in the accompanying drawings. In the following detailed description, numerous specific details are set forth to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
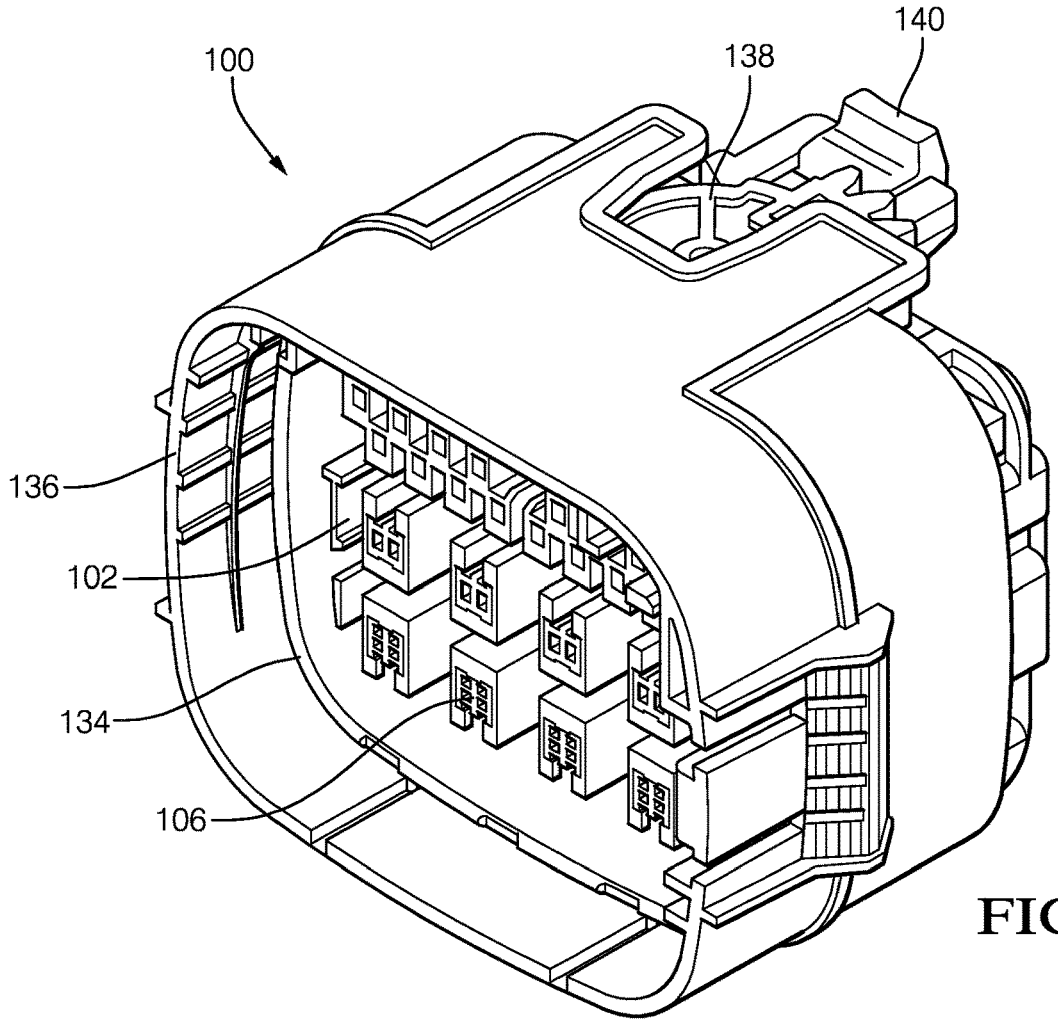
FIG. 1 is a perspective view of a connector assembly according to some embodiments.
Figure 2:
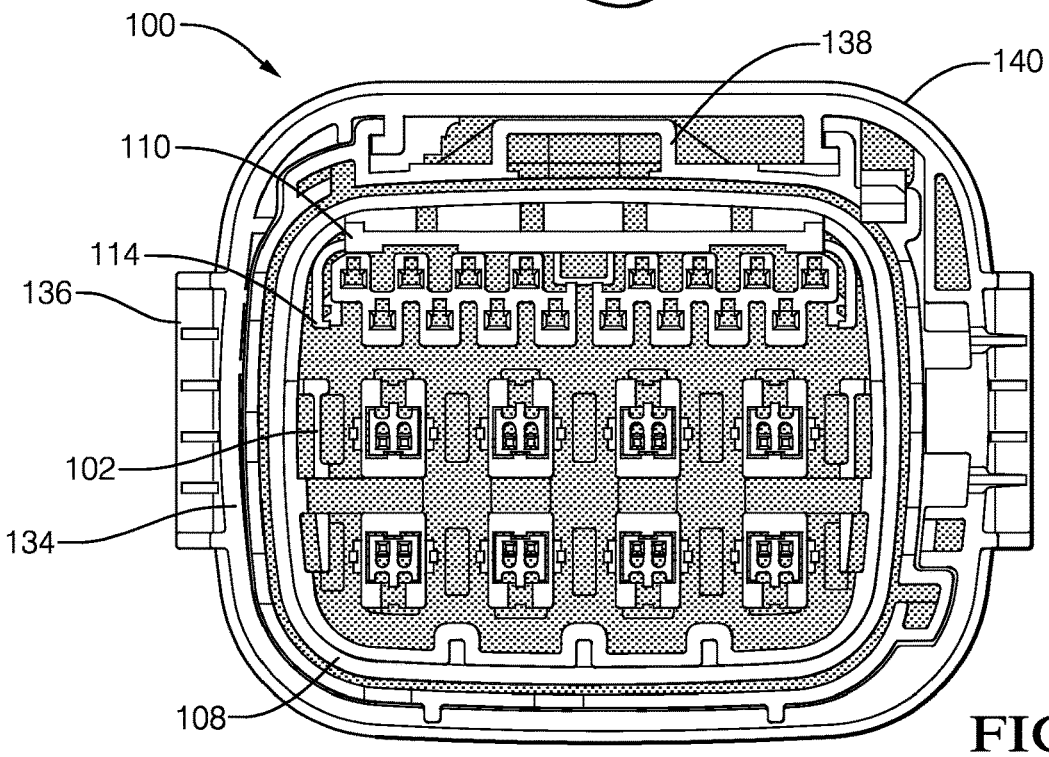
FIG. 2 is an end view of the connector assembly of FIG. 1 according to some embodiments.
Figure 3:
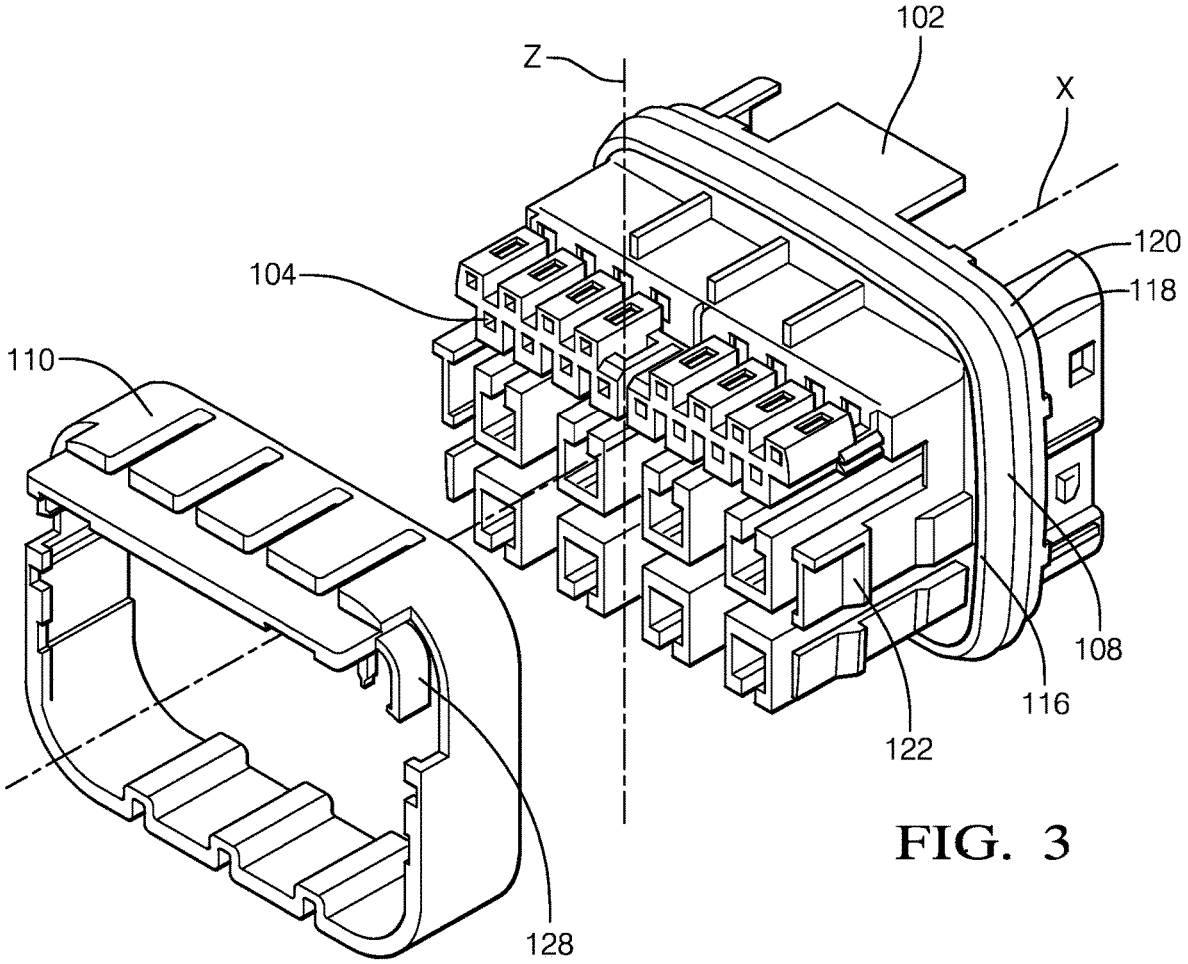
FIG. 3 is a partial exploded view of a subassembly of the connector subassembly of FIG. 1 according to some embodiments.
Figure 4:
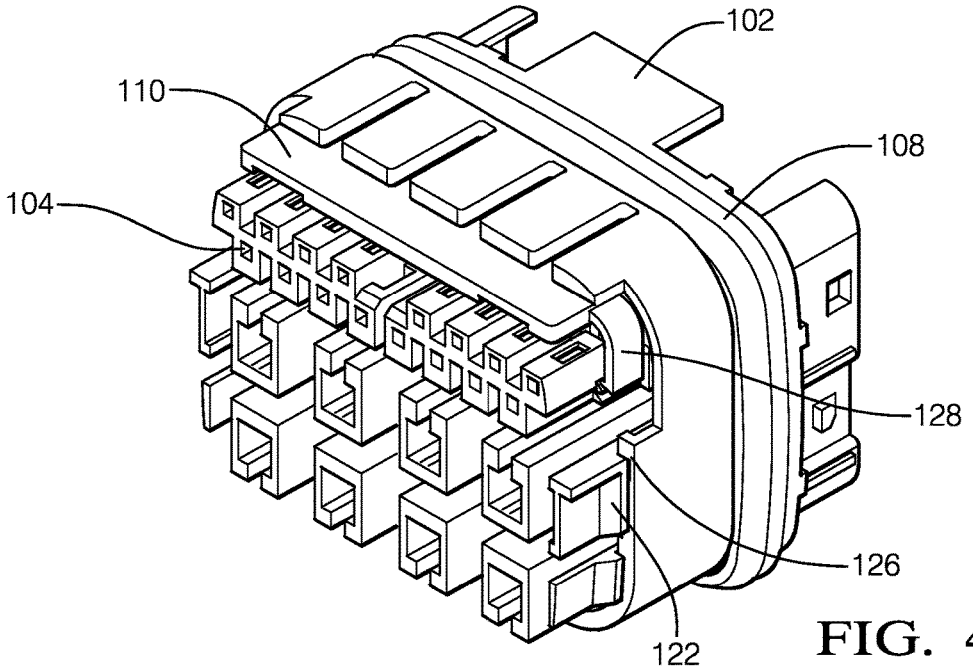
FIG. 4 is a perspective view of the subassembly of FIG. 3 in an assembled condition according to some embodiments.
Figure 5:
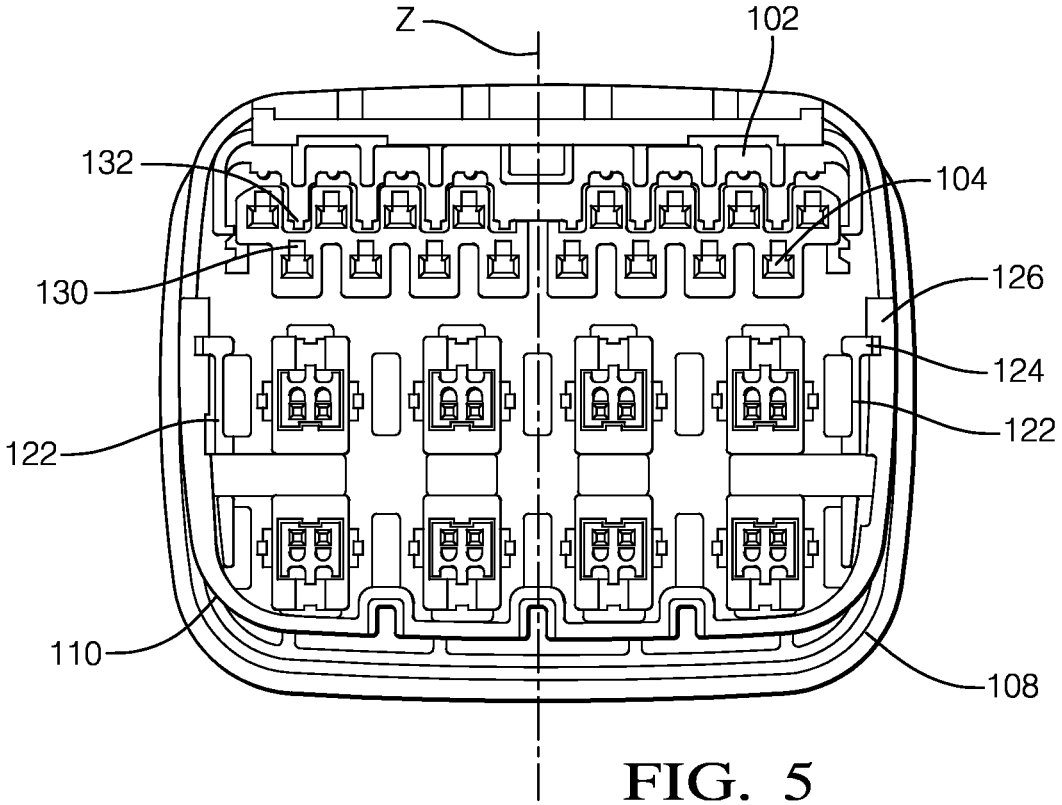
FIG. 5 is an end view of the subassembly of FIG. 4 according to some embodiments.
Figure 6:
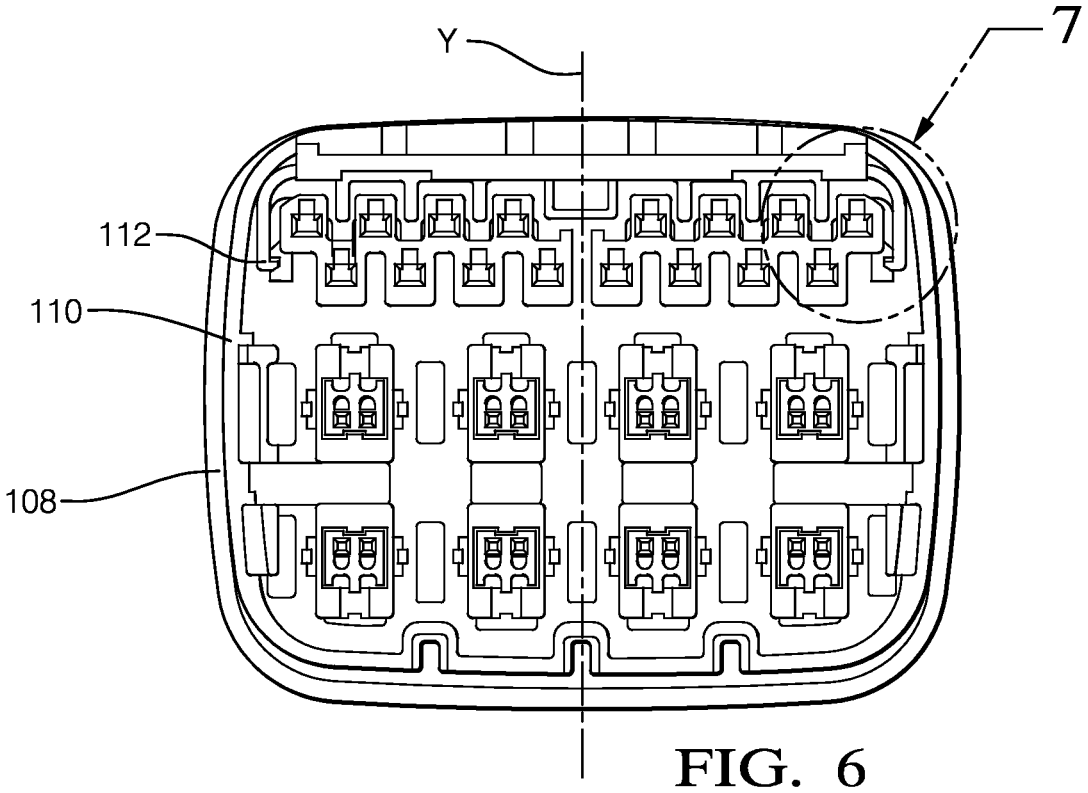
FIG. 6 is an end view of the subassembly of FIG. 4 with a retainer in a pre-staged position according to some embodiments.
Figure 7:
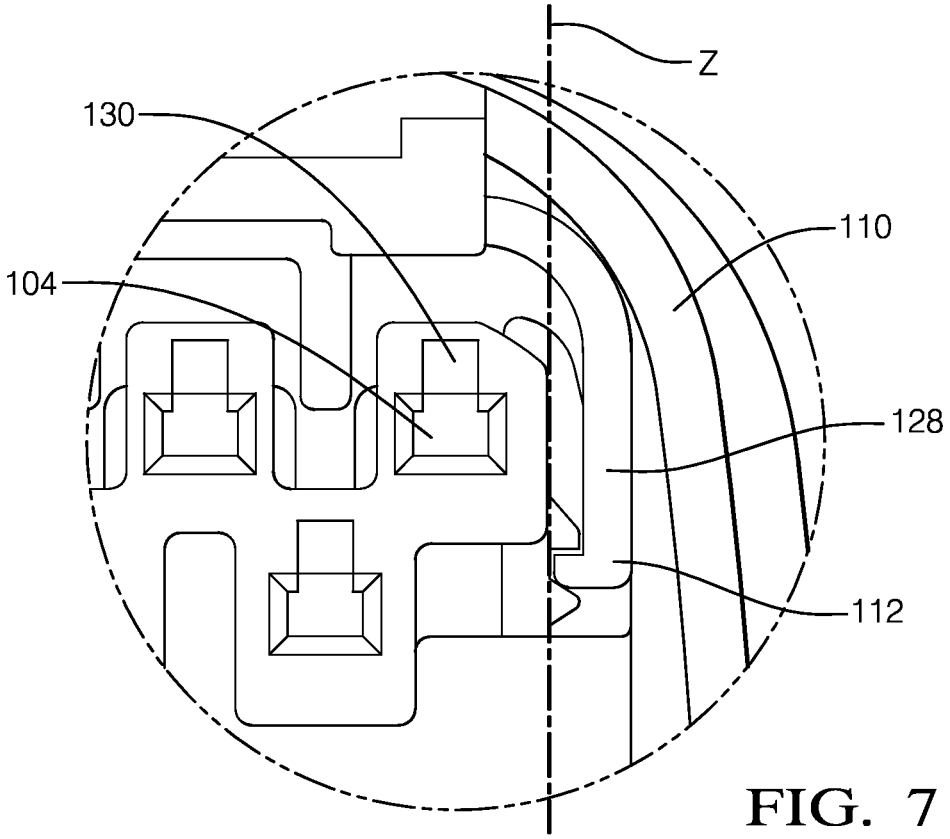
FIG. 7 is a close-up end view of the subassembly of FIG. 6 with a retainer in the pre-staged position according to some embodiments.
Figure 9:
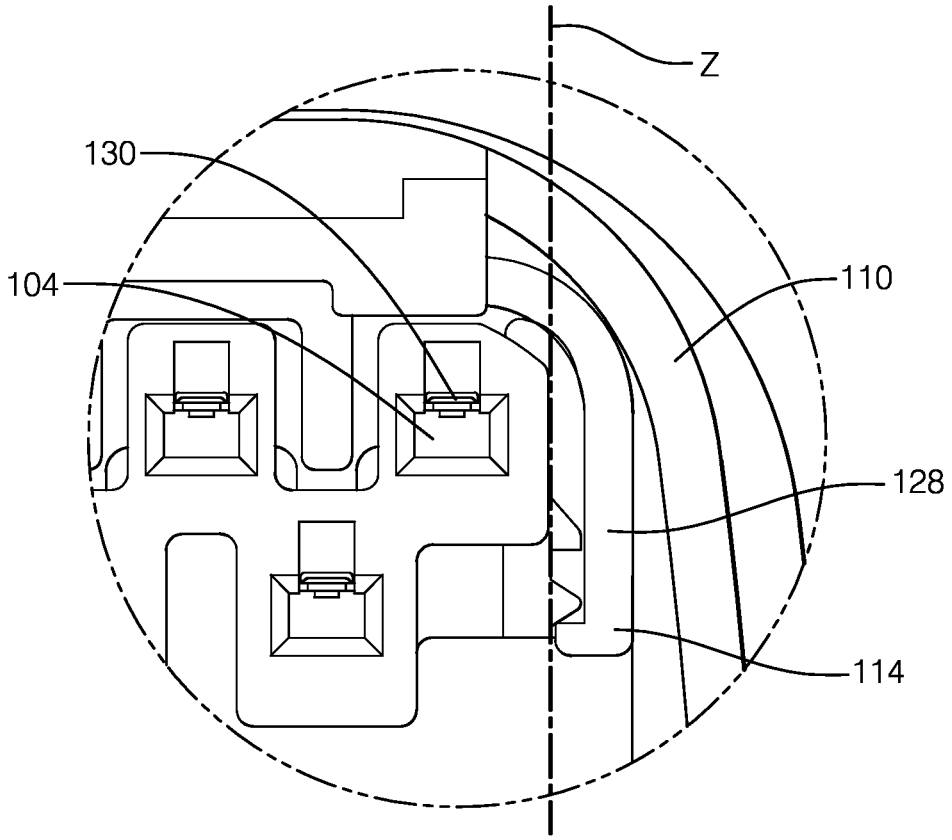
FIG. 9 is a close-up end view of the subassembly of FIG. 8 with the retainer in a staged position according to some embodiments.

FIGS. 1 and 2 illustrate a sealed electrical connector assembly according to one of the embodiments. The connector assembly 100 is configured to be received within a corresponding mating connector assembly (not shown) and provide an electrical connection that is sealed from intrusion of environmental contaminants such as dirt, dust, water, or other fluids. The connector assembly 100 includes an inner connector body 102, shown in FIGS. 3 and 4, that defines a plurality of terminal cavities 104. The terminal cavities 104 are configured to accept and retain electrical terminals 106 attached to the ends of wire electrical cables. The terminal cavities 104 extend along a longitudinal mating axis X. As shown in FIG. 4, a seal 108 formed of a compliant material, such as a silicone rubber, peripherally surrounds the inner connector body 102. A retainer 110 that peripherally surrounds a portion of the inner connector body is illustrated in FIG. 4. The retainer 110 is movable to a first position 112 in which the retainer 110 inhibits movement of the seal 108 along the mating axis X and allows insertion of the terminals 106 within the terminal cavities 104 illustrated in FIG. 6. The retainer 110 is further movable from the first position 112 to a second position 114 in which the retainer 110 inhibits movement of the seal 108 along the mating axis X and inhibits removal of the terminals 106 from the terminal cavities 104 as illustrated in FIG. 9. When in the first position 112 or in the second position 114, the retainer 110 extends around a forward face 116 of the seal 108 while a rearward face 118 of the seal is adjacent a wall 120 of the inner connector body 102. The retainer 110 is movable along the mating axis X to the first position 112 as can be seen in FIGS. 3 and 4. The retainer 110 is movable from the first position 112 to the second position 114 along a transverse axis Y that is perpendicular to the mating axis X as seen in FIGS. 7 and 9. The retainer 110 is configured to inhibit the seal 108 from deforming along the mating axis X as the connector assembly 100 is moved within the corresponding mating connector.

The inner connector body 102 further includes a first pair of flexible locking features 122, best seen in FIGS. 3 and 4, that are configured to maintain a location of the retainer along the mating axis X when the retainer 110 is in either the first position 112 or in the second position 114. The first flexible locking features 122 defines longitudinal ribs 124 that engage grooves 126 in the retainer 110 to guide the retainer 110 along the mating axis X as the retainer 110 is moved into the first position 112. The inner connector body also includes a second pair of flexible locking features 128 that are configured to maintain a location of the retainer 110 along the transverse axis Y when the retainer 110 is in the first position 112 and release the retainer 110 to move along the transverse axis Y to the second position 114. The inner connector body 102 defines flexible primary terminal locks 130 within the terminal cavities 104 configured to allow insertion of the terminals 106. The retainer 110 includes rigid secondary terminal locks 132 that are configured to inhibit removal of the terminals 106 from the terminal cavities 104.

Figure 8:
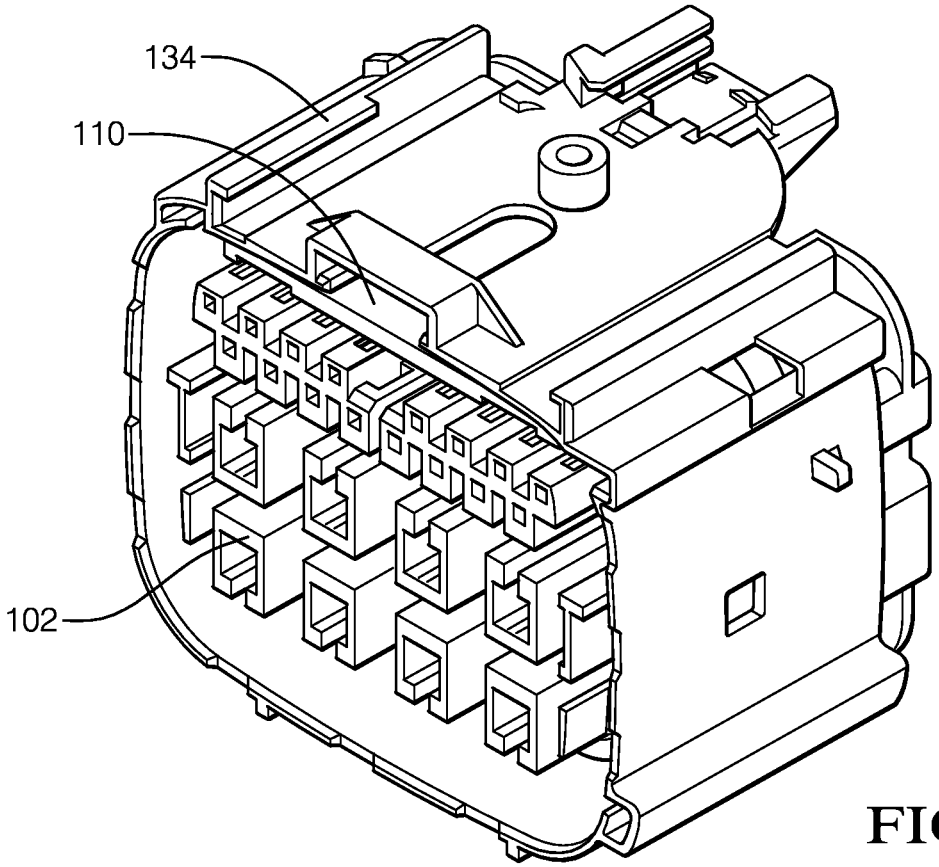
FIG. 8 is a perspective view of the subassembly of FIG. 4 disposed within an outer connector body according to some embodiments.

As shown in FIG. 8, the connector assembly 100 also includes an outer connector body 134 within which the inner connector body 102 is disposed. As illustrated in FIG. 1, the connector assembly 100 further includes a slide 136 which activates a combined pinion gear and cam member 138 similar to the disclosure of U.S. Pat. No. 7,241,155 hereby incorporated by reference. The connector assembly 100 also includes a connector position assurance device 140.

Figure 10:
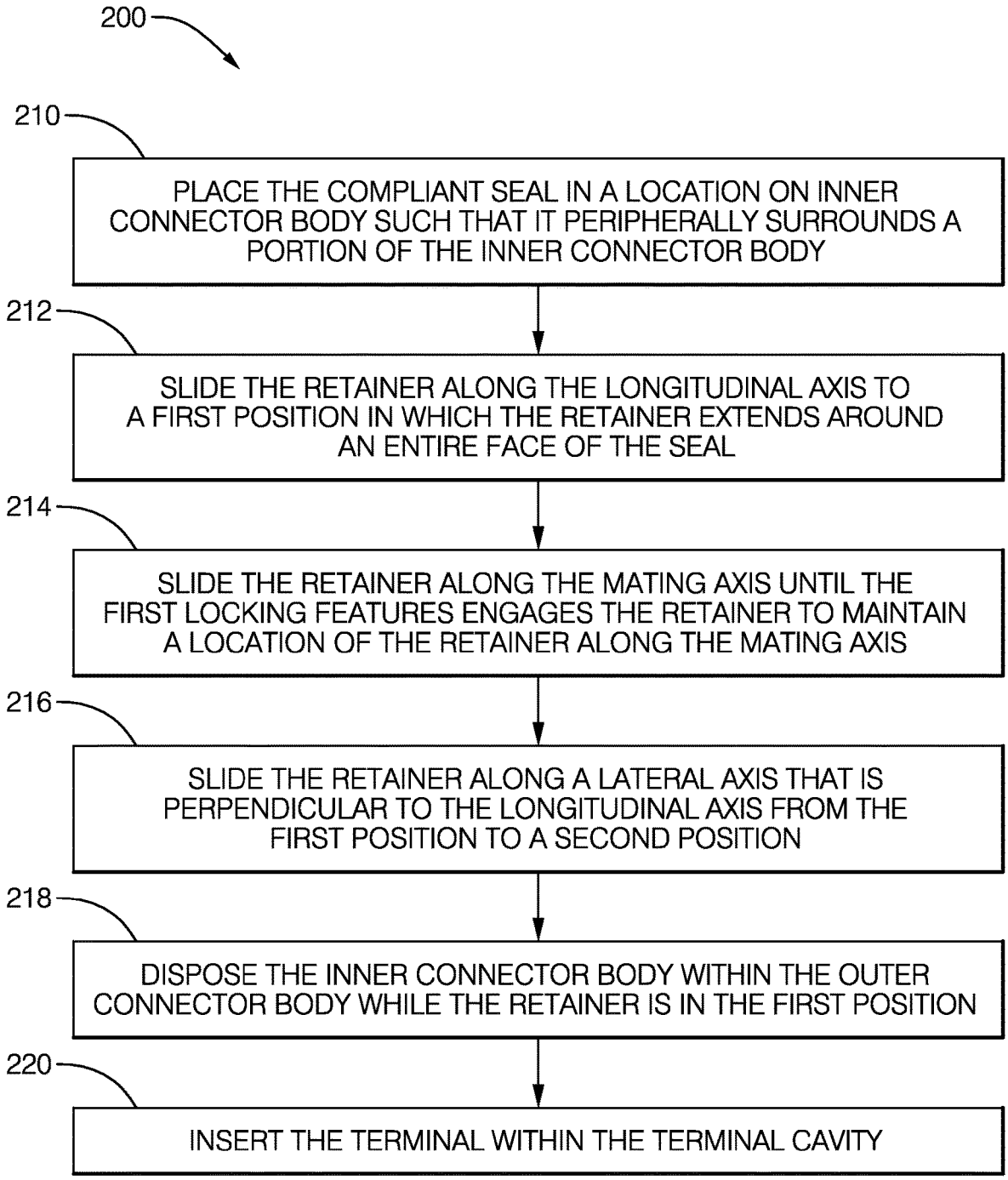
FIG. 10 is a flow chart of a method of assembling a connector according to some embodiments.

FIG. 10 illustrates a method 200 of assembling a connector having an inner connector body 102 extending along a longitudinal mating axis and defining a terminal cavity 104 configured to receive a terminal 106 therein, a compliant seal 108, a retainer 110 movable along the mating axis X, and an outer connector body 134, e.g. the connector assembly 100 described above. The retainer 110 is configured to inhibit the seal 108 from deforming along the mating axis X as the connector is received within a mating connector. The various steps of the method are described below.

STEP 210, PLACE THE COMPLIANT SEAL IN A LOCATION ON THE INNER CONNECTOR BODY SUCH THAT IT PERIPHERALLY SURROUNDS THE INNER CONNECTOR BODY, includes placing the compliant seal 108 in a location on the inner connector body 102 such that it peripherally surrounds the inner connector body 102;

STEP 212, SLIDE THE RETAINER ALONG THE MATING AXIS TO A FIRST POSITION IN WHICH THE RETAINER EXTENDS AROUND THE SEAL, includes sliding the retainer 110 along the mating axis X to a first position 112 in which the retainer 110 extends around the seal 108, thereby inhibiting movement of the seal 108 along the mating axis X and in which the retainer 110 allows insertion of the terminal 106 within the terminal cavity 104;

STEP 214, SLIDE THE RETAINER ALONG THE MATING AXIS UNTIL THE FIRST LOCKING FEATURES ENGAGES THE RETAINER TO MAINTAIN A LOCATION OF THE RETAINER ALONG THE MATING AXIS, includes sliding the retainer 110 along the mating axis X until first locking features 122 engages the retainer 110 to maintain a location of the retainer 110 along the mating axis X. The inner connector body 102 may further include second flexible locking features 132 that are configured to maintain a location of the retainer 110 along the transverse axis Y when the retainer is in the first position 112 and release the retainer 110 to move along the transverse axis Y to the second position 114. The first locking features 122 may further include longitudinal ribs 124 that engage grooves 126 in the retainer 110 that are configured to guide the retainer 110 along the mating axis X as the retainer is moved into the first position 112;

STEP 216, SLIDE THE RETAINER ALONG A TRANSVERSE AXIS THAT IS PERPENDICULAR TO THE MATING AXIS FROM THE FIRST POSITION TO A SECOND POSITION CONFIGURED TO RETAIN THE SEAL TO THE CONNECTOR BODY AND RETAIN THE TERMINAL WITHIN THE TERMINAL CAVITY, includes sliding the retainer 110 along a transverse axis Y that is perpendicular to the mating axis X from the first position 112 to a second position 114 configured to retain the seal 108 to the inner connector body 102 and retain the terminal 106 within the terminal cavity 104. The retainer 110 inhibits movement of the seal 108 along the mating axis X when the retainer 110 is in the second position 114;

STEP 218, DISPOSE THE INNER CONNECTOR BODY WITHIN THE OUTER CONNECTOR BODY WHILE THE RETAINER IS IN THE FIRST POSITION, includes disposing the inner connector body 102 within the outer connector body 134 while the retainer 110 is in the first position 112; and STEP 220 INSERT THE TERMINAL WITHIN THE TERMINAL CAVITY, includes inserting the terminal 106 within the terminal cavity 104.

The example presented herein is directed to a connector assembly in which the conductors are insulated electrical cables. However, alternative embodiments of the connector assembly may be envisioned in which the conductors are fiber optic cables, pneumatic tubes, hydraulic tubes, or a hybrid assembly having a combination of any of these conductors. These conductors may be terminated by fittings which may be characterized as terminals.

Accordingly, a connector assembly 100 and a method 200 of assembling a connector is provided. The retainer 110 of the connector assembly 100 and the method 200 provides the benefit of inhibiting the seal 108 from deforming, particularly stopping the seal from rolling, when the connector assembly 100 is inserted or removed from a corresponding mating connector. The retainer 110 also provides the benefit of providing an integral secondary lock feature 132 for the connector assembly 100 to retain terminals 106 in their proper position within the terminal cavities 104.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a situation or material to the teachings of the invention without departing from its scope. Dimensions, types of materials, orientations of the various components, and the number and positions of the various components described herein are intended to define parameters of certain embodiments and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any order of arrangement, order of operations, direction or orientation unless stated otherwise.

We claim:

1. A connector assembly, comprising:

a connector body defining a terminal cavity to receive a terminal therein and extending along a longitudinal mating axis;

a compliant seal peripherally surrounding the connector body; and a unitary retainer peripherally surrounding a portion of the connector body and movable to a first position in which the retainer inhibits movement of the seal along the mating axis and allows insertion of the terminal within the terminal cavity and wherein the retainer is further movable from the first position to a second position in which the retainer inhibits movement of the seal along the mating axis and inhibits removal of the terminal from the terminal cavity, wherein the retainer is movable along the mating axis to the first position and wherein the retainer is movable from the first position to the second position along a transverse axis that is perpendicular to the mating axis and wherein the connector body further comprises first flexible locking features to maintain a location of the retainer along the mating axis and allow movement of the retainer along the transverse axis from the first position to the second position.

2. The connector assembly according to claim 1, wherein the retainer extends around a face of the seal.

3. The connector assembly according to claim 1, wherein the retainer is movable along the mating axis to the first position and wherein the retainer is movable from the first position to the second position along a transverse axis that is perpendicular to the mating axis.

4. The connector assembly according to claim 1, wherein the connector body further comprises second flexible locking features to maintain a location of the retainer along the transverse axis when the retainer is in the first position and release the retainer to move along the transverse axis to the second position.

5. The connector assembly according to claim 4, wherein the connector body further comprises longitudinal ribs configured to guide the retainer along the mating axis as the retainer is moved into the first position.

6. The connector assembly according to claim 5, wherein the first flexible locking features defines the longitudinal ribs.

7. The connector assembly according to claim 1, wherein the connector body is an inner connector body and wherein the connector assembly further comprises: an outer connector body within which the inner connector body is disposed.

8. The connector assembly according to claim 7, wherein the retainer is inhibits the seal from deforming along the mating axis as the connector assembly is moved within a corresponding mating connector.

9. The connector assembly according to claim 1, wherein the connector body defines a flexible primary terminal lock within the terminal cavity to allow insertion of the terminal and wherein the retainer includes a rigid secondary terminal lock configured to inhibit removal of the terminal from the terminal cavity.

10. A method of assembling a connector having an inner connector body extending along a longitudinal mating axis and defining a terminal cavity configured to receive a terminal therein, a compliant seal, a retainer movable along the mating axis, and an outer connector body, the method comprising:

placing the compliant seal in a location on the inner connector body such that it peripherally surrounds the inner connector body;

sliding the retainer along the mating axis to a first position in which the retainer extends around the seal, thereby inhibiting movement of the seal along the mating axis and in which the retainer allows insertion of the terminal within the terminal cavity;

disposing the inner connector body within the outer connector body while the retainer is in the first position; and inserting the terminal within the terminal cavity; and sliding the retainer along a transverse axis that is perpendicular to the mating axis from the first position to a second position to retain the seal to the connector body and retain the terminal within the terminal cavity, wherein the retainer inhibits movement of the seal along the mating axis when the retainer is in the second position, wherein the inner connector body further comprises first flexible locking features and wherein the method further includes sliding the retainer along the mating axis until the first locking features engages the retainer to maintain a location of the retainer along the mating axis, wherein the first locking feature allows movement of the retainer along the transverse axis from the first position to the second position .

11. The method according to claim 10, wherein the connector body further comprises second flexible locking features configured to maintain a location of the retainer along the transverse axis when the retainer is in the first position and release the retainer to move along the transverse axis to the second position.

12. The method according to claim 11, wherein the connector body further comprises longitudinal ribs to guide the retainer along the mating axis as the retainer is moved into the first position.

13. The method according to claim 12 wherein the first flexible locking features defines the longitudinal ribs.

14. The method according to claim 10, wherein the retainer inhibits the seal from deforming along the mating axis as the connector is received within a mating connector.

* * * * *